US005695420A

United States Patent [19]

Bellehumeur

[11] Patent Number: 5,695,420

[45] **Date of Patent: *Dec. 9, 1997**

[54] HOCKEY PUCK

[76] Inventor: Alex R. Bellehumeur, 6242 Napoli Ct., Long Beach, Calif. 90603

[ * ] Notice: The term of this patent shall not extend beyond the expiration date of Pat. No. 5,275,410.

[21] Appl. No.: 513,681

[22] Filed: Jul. 28, 1995

Related U.S. Application Data

[63] Continuation of Ser. No. 285,720, Aug. 4, 1994, abandoned, which is a continuation-in-part of Ser. No. 150,420, Nov. 10, 1993, abandoned, which is a division of Ser. No. 949,077, Sep. 22, 1992, Pat. No. 5,275,410.

[51] Int. Cl.[6] ..... A63B 71/00

[52] U.S. Cl. ..... 473/588; 473/589

[58] Field of Search ..... 273/126, 128; 473/588, 589

[56] References Cited

U.S. PATENT DOCUMENTS

| | | | |
|---|---|---|---|
| 2,226,516 | 12/1940 | Ross | 273/128 R |
| 2,606,030 | 8/1952 | Tjomsland | 273/128 R |
| 2,640,699 | 6/1953 | Garbo | 273/128 R |
| 5,269,520 | 12/1993 | Vellines | 273/128 R |
| 5,275,410 | 1/1994 | Bellehumeur et al. | 273/128 R |

*Primary Examiner*—Raleigh W. Chiu
*Attorney, Agent, or Firm*—Edgar W. Averill, Jr.

[57] ABSTRACT

An ice hockey puck being generally in the shape of a disk and having several voids passing from the upper to the lower surface. Preferably the puck also has beveled corners. The result is a puck which is safer to use, faster and more accurate than the conventional ice hockey puck and yet which handles in a very similar manner to a conventional ice hockey puck.

8 Claims, 2 Drawing Sheets

HOCKEY PUCK

CROSS REFERENCE TO RELATED APPLICATIONS

This is a continuation of application Ser. No. 08/285,720 filed on Aug. 4, 1994 now abandoned which was a CIP of Ser. No. 08/150,420 filed Nov. 10, 1993 now abandoned which was a divisional application of application Ser. No. 07/949,077 filed Sep. 22, 1992, which issued as U.S. Pat. No. 5,275,410 on Jan. 1, 1994.

BACKGROUND OF THE INVENTION

The field of the invention is sporting goods and the invention relates more particularly to the game of hockey and still more particularly to the game of ice hockey. Ice hockey pucks made from a disk of hard rubber having an outside diameter of about three (3) inches and a height of about one inch have been in use for at least 100 years.

While such long use indicates satisfactory design, the conventional ice hockey puck does result in injuries to players. Such injuries typically consist of bruises but can occasionally be more serious such as chipped teeth and a broken nose.

SUMMARY OF THE INVENTION

It is an object of the present invention to provide a hockey puck which is safer to use than the conventional ice hockey puck.

The present invention is for a hockey puck having a flat outer peripheral surface, an upper surface and a lower surface and having a plurality of open voids passing from the upper surface to the lower surface. The hockey puck preferably has a void volume between about 10% and 35% of the overall volume of the puck. In a preferred configuration a hockey puck has an outer ring and an inner central member held to the outer ring by a plurality of connectors and having void areas between the connectors. Preferably the central portion is recessed and further contains a disk shaped central recess. The purpose of the recess is to prevent damage to labels.

DESCRIPTION OF THE PREFERRED EMBODIMENTS

Figure 1:
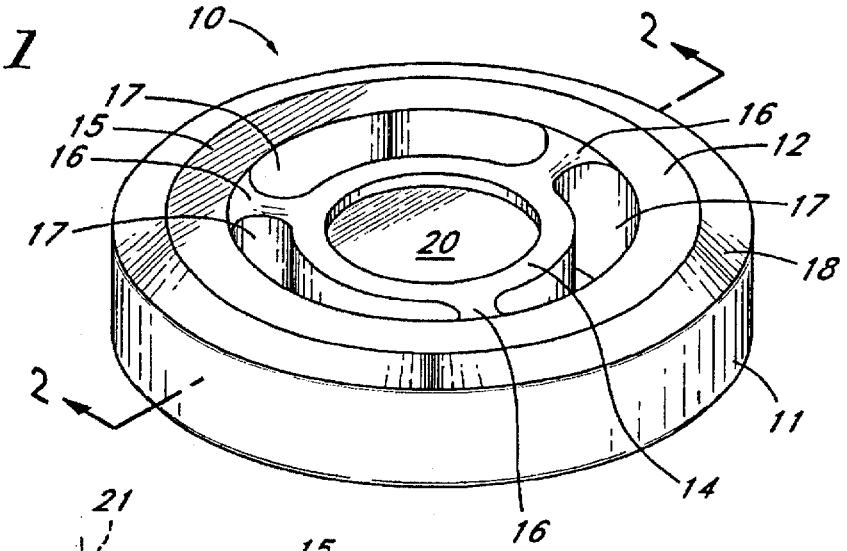
FIG. 1 is a perspective view of the hockey puck of the present invention.
Figure 2:
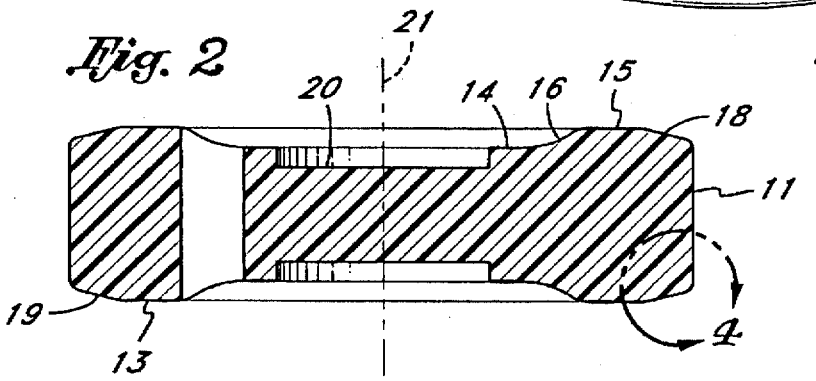
FIG. 2 is a cross sectional view taken along line 2—2 of FIG. 1.

The hockey puck of the present invention is shown in perspective view in FIG. 1 and indicated generally by reference character 10. Puck 10 has a flat outer peripheral surface 11, an upper surface 12 and a lower surface 13. An inner central member 14 is held to an outer ring 15 by three or more arms, spokes or connectors 16. Three or more open voids 17 are formed between the connectors and inner central member 14. Outer ring 15 has a circular outer surface but need not be circular at the inner surface. The arms or connectors can vary in configuration.

Figure 4:
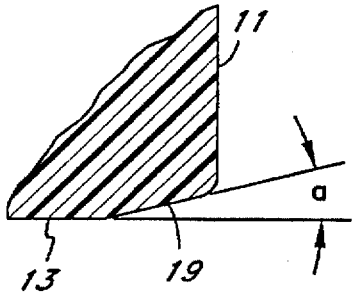
FIG. 4 is an enlarged view of the lower corner ring of the puck of FIG. 1.

Puck 10 has an upper corner ring 18 and a lower corner ring 19 which are preferably beveled as shown best in FIG. 4 where a bevel of for instance 14° is shown and indicated by reference character "a". Furthermore, a specific dimension is preferred where the bevel raises 1/16" from the lower surface 13 and extends inwardly from the outer peripheral surface 11 a distance of about ¼". The bevel can be any angle such as 45° which has at least two benefits. The bevel eliminates the sharp edge which is present along the upper and lower corners of the conventional puck. Furthermore, the beveling prevents snow plowing and ice buildup as the puck moves along the ice surface. This snow and ice buildup will show the puck down and can divert the direction of the puck. The beveled puck skims over loose ice and snow and increases accuracy and maintains speed between the non-chamfered puck.

Preferably the central member 14 has a central disk recess 20 which facilitates the placing of a label and the depth of which can effect the weight of the puck. The entire center area within the outer ring 15 can be recessed to create a desired puck weight. Of course, the outer ring 15 has a central axis 21 which coincides with the central axis 21 of inner central member 14.

In a preferred shape the puck has three arc shaped open voids 17 which have a width indicated by reference character "b" of 5/16" and three arms or connectors 16 which have a width indicated by reference character "c" of about ¼". The dimension is, of course, illustrative and not by way of limitation.

Figure 5:
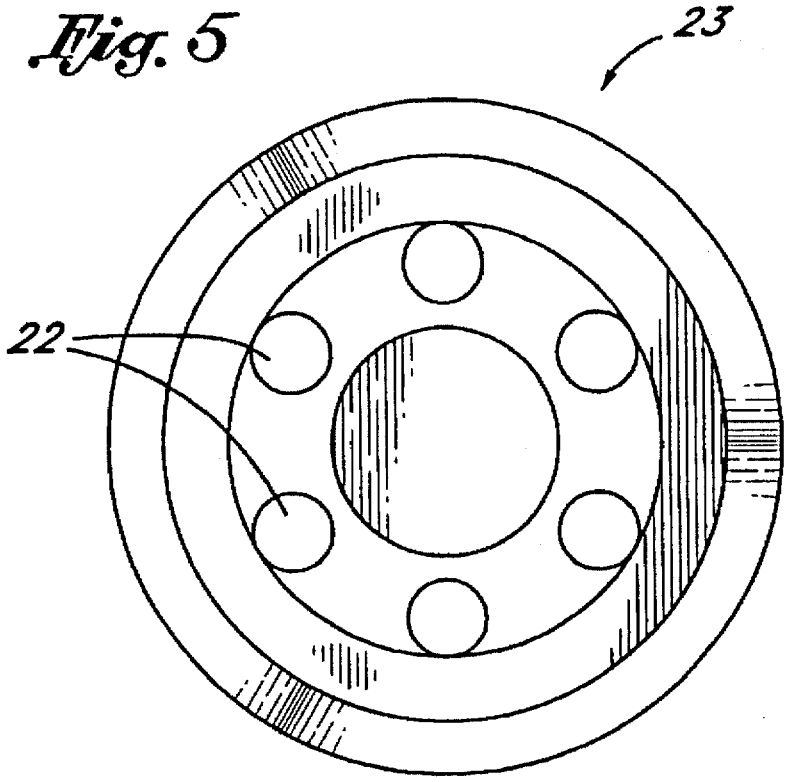
FIG. 5 is a plan view of an alternative embodiment of the puck of FIG. 1.
Figure 6:
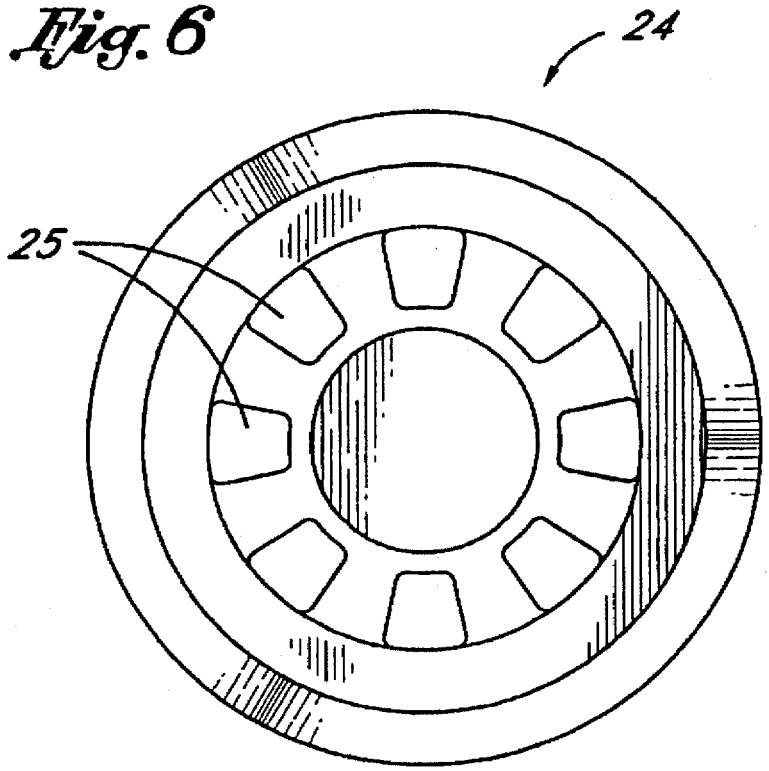
FIG. 6 is a plan view of an alternative embodiment of the puck of FIG. 1.

While the preferred shape of the puck is shown in FIGS. 1–4, other shaped voids are also contemplated such as the circular voids shown in FIG. 5 and indicated by reference character 22 in puck 23. In FIG. 6 puck 24 has generally polygonal voids 25. The voids may not be regularly shaped but could be oblong or curved such as the shape of a boomerang. The amount of void area is preferably between 10% and 35% of the overall volume of the puck. By the puck volume it is intended to indicate the total disk shape volume as if the puck were a conventional ice hockey puck and from this volume of about 10% and about 35% of the volume should be removed with voids which pass from the upper to the lower surface. Preferably this void space should be about 16%.

The material of construction of the puck can be conventional rubber of the type which is used in conventional ice hockey pucks. The puck could also be fabricated from other similar polymers such as polyvinylchloride, ABS and the like.

Figure 3:
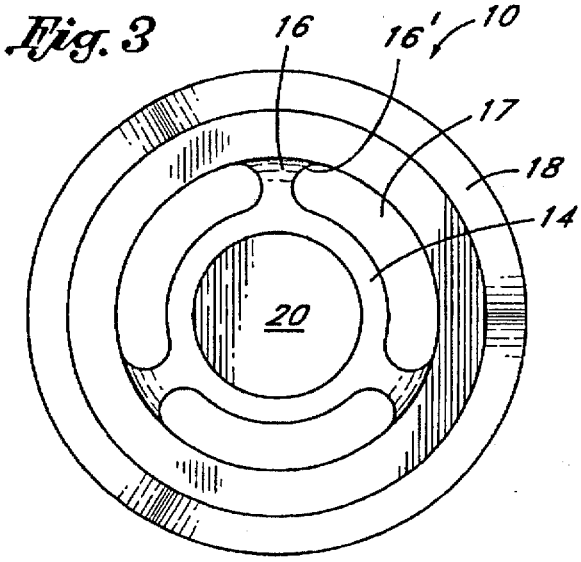
FIG. 3 is a plan view thereof.

The openings in the puck of the present invention have numerous benefits. They prevent a frisbee or sailing effect as compared to a puck with no voids since there is an airflow through the voids. The openings also give resilience to the puck which can increase the speed with which a puck is propelled by a hockey stick. That is, as the puck is moving along the blade, it will deflect slightly and then spring off the blade with greater speed than a conventional puck. Furthermore, the openings can provide a very wide range of weight adjustment and pucks of various sizes for young children, teenagers and adults can be made. The lighter weight also provides improved safety since a lighter puck has less inertia. Furthermore, the openings provide a cushioning effect which also provides increased safety. The taper around the upper and lower ring of the puck eliminates sharp edges and preferably these edges are also slightly rounded. The taper also, as set forth above, reduces show plowing. The arms or connectors of the puck of the present invention as shown in FIGS. 1 and 3 are preferably rounded or relieved (see for instance at reference character 16') to reduce the chance of breakage during impact.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An ice hockey puck on an ice surface comprising:

an outer ring having a flat outer peripheral surface and a central axis, an outer surface, an upper surface and a lower surface and an upper corner ring and a lower corner ring and wherein the upper and lower corner rings are beveled;

an inner central member held to the outer ring by a plurality of connectors, said central member having a central axis aligned with the central axis of the outer ring, said inner central member having an upper surface and a lower surface which respectively do not extend above or below the upper and lower surface of said outer ring; and a plurality of open voids between the connectors.

2. The ice hockey puck of claim 1 wherein the bevel extends about 1/16" from a surface and inwardly about 1/4".

3. The hockey puck of claim 1 wherein there are three connectors.

4. The ice hockey puck of claim 1 wherein the upper and lower surfaces of the central member are recessed from the upper and lower surfaces of the outer ring.

5. The ice hockey puck of claim 4 wherein the central member has a recessed central ring.

6. The ice hockey puck of claim 1 wherein there are three identical arc shaped voids.

7. The ice hockey puck of claim 6 wherein the three arc shaped voids have a width of about 5/16".

8. The ice hockey puck of claim 6 wherein the connectors are about 1/4" wide and relieved as they connected with the outer ring and with the inner central member.

* * * * *